US008542842B2

(12) United States Patent
Zaccaria

(10) Patent No.: US 8,542,842 B2
(45) Date of Patent: Sep. 24, 2013

(54) REMOTE PROGRAMMING SYSTEM FOR PROGRAMMABLE HEARING AIDS

(76) Inventor: Richard Zaccaria, Baldwinsville, NY (US)

( * ) Notice: Subject to any disclaimer, the term of this patent is extended or adjusted under 35 U.S.C. 154(b) by 918 days.

(21) Appl. No.: 12/691,277

(22) Filed: Jan. 21, 2010

(65) Prior Publication Data

US 2011/0176686 A1 Jul. 21, 2011

(51) Int. Cl.
*H04R 29/00* (2006.01)
*H04R 25/00* (2006.01)

(52) U.S. Cl.
USPC ..... 381/60; 381/315; 600/559

(58) Field of Classification Search
USPC ..... 381/312, 315, 60, 23.1; 600/559; 73/585; 455/3.01, 3.05
See application file for complete search history.

(56) References Cited

U.S. PATENT DOCUMENTS

| | | | | |
|---|---|---|---|---|
| 5,226,086 | A * | 7/1993 | Platt | 381/58 |
| 5,710,819 | A | 1/1998 | Topholm et al. | |
| 6,594,370 | B1 * | 7/2003 | Anderson | 381/315 |
| 6,840,908 | B2 | 1/2005 | Edwards et al. | |
| 7,181,297 | B1 * | 2/2007 | Pluvinage et al. | 700/94 |
| 7,200,237 | B2 * | 4/2007 | Zhang et al. | 381/60 |
| 7,257,372 | B2 * | 8/2007 | Kaltenbach et al. | 455/41.2 |
| 7,430,299 | B2 | 9/2008 | Armstrong et al. | |
| 7,451,256 | B2 | 11/2008 | Hagen et al. | |
| 7,650,004 | B2 * | 1/2010 | Durant | 381/312 |
| 7,778,829 | B2 * | 8/2010 | Kumar et al. | 704/228 |
| 2002/0165466 | A1 | 11/2002 | Givens et al. | |
| 2006/0039577 | A1 * | 2/2006 | Sanguino et al. | 381/315 |
| 2006/0153395 | A1 * | 7/2006 | van Den Heuvel et al. | 381/60 |
| 2006/0188116 | A1 * | 8/2006 | Frerking et al. | 381/315 |
| 2007/0098195 | A1 | 5/2007 | Holmes | |
| 2008/0013763 | A1 | 1/2008 | Lotter et al. | |
| 2008/0107278 | A1 | 5/2008 | Roeck et al. | |
| 2008/0165994 | A1 | 7/2008 | Caren et al. | |
| 2009/0062687 | A1 | 3/2009 | Givens et al. | |
| 2009/0074216 | A1 | 3/2009 | Bradford et al. | |
| 2009/0154741 | A1 | 6/2009 | Woods et al. | |
| 2010/0054512 | A1 * | 3/2010 | Solum | 381/315 |

* cited by examiner

*Primary Examiner* — Xu Mei
(74) *Attorney, Agent, or Firm* — Bernhard P. Molldrem, Jr.

(57) ABSTRACT

Bluetooth-enabled programmable digital hearing aids can be adjusted remotely and in real time. The hearing aid patient at home or a location convenient to the patient logs on to a hearing clinic web site to connect with a clinician, e.g. audiologist or hearing aid technician, at a central clinic location. The patient computer is provided with software for this and the patient is provided with a wireless hearing aid adjustment device. The clinician downloads the patient's hearing aid program and other data, and then makes adjustments and reprograms the hearing aids in real time.

11 Claims, 3 Drawing Sheets

REMOTE PROGRAMMING SYSTEM FOR PROGRAMMABLE HEARING AIDS

BACKGROUND OF THE INVENTION

This invention relates to programmable digital hearing aids, and is more specifically concerned with an improved arrangement and technique to permit the audiologist, dispenser or other clinician to effect changes to the hearing aid programs for a patient's hearing aid(s). In particular, the invention is concerned with a technique and arrangement that permits the patient to contact the clinician, and allow the clinician, who is located at a central clinic facility, to analyze the performance of the patient's hearing aids while the patient is at a location remote from the clinic facility, and to adjust the patient's hearing aid program(s) to improve their performance and to help address any problems or objections that the patient may be having. This is carried out in real time, and with interaction between the patient and the clinician. The clinician may be an hearing aid dispenser, an audiologist, a technician or other hearing aid practitioner.

Modern hearing aids or hearing instruments can be provided for patients who may have hearing losses that may be moderate or severe and may vary widely over the various bands of audio frequencies. Typically, digital hearing aids are dispensed for most patients, because they can be loaded with a digital program to address the specific hearing loss for the ear in which the hearing aid is worn, and because the audiologist or clinician can very easily adjust the performance of the device by making changes to the hearing aid program. Initially, the hearing aid or aids for a given patient are programmed in accordance with the patient's hearing loss profile for each ear. These profiles tend to approximate the actual hearing loss, as the hearing tests employed depend on the patient's response, and cannot be totally objective. After an initial fitting, the patient is expected to return to have the hearing aids adjusted to optimize their performance. The hearing patient may also need to have periodic adjustments made, reflecting changes in the patient's hearing loss and also reflecting changes in the patient's environment.

Modern digital programmable hearing aids can have rather sophisticated hearing correction programs, which may include feedback blocking, speech and noise management, wind noise cancellation, transient noise suppression, directionality, and adaptive environmental sound management, as well as programmed gain factors for each frequency band and dynamic range compression for each frequency band. On top of these features, modern digital programmable hearing aids typically have a data logging feature to track and record the performance history of the hearing aid. Modern hearing aids also have multiple programmability for use in several different environments.

A recent improvement for hearing aids of this type has been the incorporation of Bluetooth™ and/or other wireless technologies, which allows for short-range, low-power two-way radio communication with Bluetooth or Bluetooth-enabled devices. This was intended to permit the hearing aid wearer to communicate, via the hearing aids, with a Bluetooth-enabled cell phone, or to listen to a digital audio device (e.g., an MP3 player) wirelessly through the hearing aids. In effect the hearing aid gives the wearer a more pleasing sound than would be experienced via standard audio phones from the cell phone or from the audio MP3 player.

The same Bluetooth™ technology (or other wireless technology) can also allow the audiologist or clinician to download wirelessly the data stored in the patient's hearing aid or hearing aids, i.e., hearing aid program, product identification codes, and logging data concerning aid performance. The clinician can make adjustments to the patient's hearing aid program and upload that wirelessly to the hearing aid. However, because this technology involves low power and short distance communication only, and it requires the clinician and patient to be in proximity to one another for any scheduled session.

For most persons with hearing loss and who may need adjustment to their hearing instruments, it is inconvenient to make an appointment with the hearing specialist and to travel to the specialist's office. For many persons, the audiologist or hearing aid dispenser is not located nearby, and round trip travel of several hours can be involved. This can be a discouragement to persons, whose hearing aids are performing at less than optimal level, from obtaining help. Also, when the hearing patient is at the audiologist's office, he or she is in a location different from the place where the patient has experienced specific difficulties in hearing, and it may be difficult for the practitioner to duplicate, in the office, the same conditions that seem to cause the patient's hearing difficulties. Moreover, any visit to the clinician's office would have to take place during normal business office hours, which may not be a convenient time for the individual patient. For these reasons, small adjustments to the patient's hearing aid are not made when they should be made, and the patient's hearing problems continue.

A system for customizing a hearing aid device is described in published application US 2009/0154741 A1, where the hearing patient is at some distance of the clinician or device dispenser. The system downloads logged data from the patient's hearing aids and uses an adaptive fitting procedure using logged data for customizing the patient's hearing aids. This system depends on the patient inputting data, and making selections, and also employs a generic algorithm for fitting the hearing aid, with no provision for input from, or to, an audiology clinician. There is also no provision for real-time feedback from the patient about hearing aid performance while he or she is wearing the hearing aids.

Other systems for remote adjustment of hearing aids have required the patient to select and download pre-determined program settings, without benefit of consultation with a hearing aid clinician in the process.

OBJECTS AND SUMMARY OF THE INVENTION

Accordingly, it is an object of the present invention to facilitate the adjustment of hearing aid parameters for a given patient, by making real-time contact simpler for both the hearing patient and the clinician, and permitting the patient to visit the clinician for either routine or special matters without having to travel to the clinic location.

It is a more specific object to provide equipment and a technique to facilitate a session between the audiologist or other hearing practitioner and the hearing patient, permitting the clinician to interact in real time with the patient and make what adjustments are required to the programs for the patient's hearing aid, and to clear up the patient's hearing problems as quickly and as economically as possible.

In accordance with one aspect of the present invention, an arrangement for interactive real-time remote analysis and adjustment of a hearing aid for a hearing patient, permits a hearing aid clinician at a central clinic location to analyze and adjust performance and program settings of one or more programmable hearing aids of the hearing patient who is present at a patient location, e.g., at the patient's home, which can be remote from said central clinic location, and can in fact be anywhere worldwide. This arrangement (explained in more detail in the ensuing description) employs, at the central clinic location, a suitably programmed computer having a processor, an interface device (i.e., keyboard, mouse, touch-screen, etc.) for use by the clinician, a video monitor screen, and an Internet connection to connect the clinician computer with a global computer network. The clinician's computer is loaded with suitable software for permitting analysis of program settings of the patient's hearing aid in real time, and also for permitting the clinician to adjust the settings of the hearing aid from the clinician's office. The clinician computer is also suitably programmed for real time communication between the clinician and the patient. At the remote patient location, the patient operates (either on his own or by means of an assistant or family member) a computer that includes a processor, a video monitor screen, a patient-computer interface device (i.e., keyboard, mouse, touch-screen, etc.) and an Internet connection to connect the patient computer with the global computer network. The computer may be of any convenient type, such as desktop, laptop, tablet, notebook, or a hand-held PDA or similar device having a display screen and capable of being controlled by a program and of connecting with the Internet. The computers are connected via Internet, enabling the clinician to install software or access software installed on the patient computer to permit the clinician to analyze program settings of the patient hearing aid and adjust the patient's hearing aid by use of the interface device of the clinician computer. That is, the clinician is able to gain control of the patient's computer, and use the patient's computer to check the performance and program settings of the patient's hearing aids, and to make changes to the hearing aid program for each hearing aid. The clinician, i.e., audiologist or device dispenser, having gained control over the patient computer, is able to manipulate the patient's computer to make the necessary adjustments to the hearing aid fitting program. The patient is also provided with a wireless device that connects (via cable or wirelessly) with the patient computer and also communicates wirelessly with the patient's hearing aid(s). The wireless device is designed so as to transmit data, corresponding to program settings of the hearing aid, between the hearing aid and the patient computer and vice versa.

The wireless device employs short-range low-power radio (i.e., Bluetooth™ protocol) to communicate with the patient's hearing aid. The wireless device can preferably be worn on the patient's neck, i.e. include a necklace incorporated with it.

When the patient is scheduled for a check up, or if the patient calls to schedule an appointment, the wireless device and the necessary software can be sent to the patient, e.g., by an overnight express service or via US Postal Service. At the same time, the patient is also provided with a pre-addressed return envelope so that the patient can return the wireless device to the central clinic location following the remote adjustment session with the clinician. The patient may purchase and retain the wireless device for a subsequent remote adjustment.

A method for interactive, real-time analysis and adjustment of a hearing aid of a patient, can be carried out between a hearing aid clinician who is located at a central clinic location and a hearing aid patient who is present at a patient location that is remote from clinic location. This patient location may be the patient's own home, the patient's office, a local clinic, senior center or Veteran's center that is convenient to the patient. The clinician is provided with a suitably programmed computer having an interface device for use by the clinician, a video monitor screen, an Internet connection to connect the clinician computer with a global computer network, and software permitting analysis of program settings of a patient's hearing aid and permitting the clinician to adjust the program settings of the patient's hearing aid. The clinician computer is adapted to provide real-time communication between the clinician at the clinic location and the patient at the patient location. At the patient location, the patient is provided with a computer including a processor, a video monitor screen, a patient-computer interface device, and an Internet connection to connect the patient computer with the global computer network. At the commencement of the session between the patient and the clinician, the required software can be installed on the patient computer to permit the clinician to connect with and control the patient's computer so that he or she can analyze and adjust the patient's hearing aid through the clinician computer connected via the global computer network with the patient computer. The patient is provided with a wireless (or wire connected) hearing aid adjustment device, as discussed above. This hearing aid adjustment device connects (by cable or wirelessly) with the patient computer and also communicates with the patient's hearing aid while the aid is present in the ear of the patient. This allows the device to obtain identification codes from the hearing aids, and also obtain the program or programs that are present on the hearing aids, so they can be transmitted to the clinician. Depending on the sophistication of the hearing aid design, the device may also permit the clinician to speak with (and listen to) the patient. Otherwise, this may be done using built in features on the computer.

After the wireless hearing aid adjustment device obtains the program settings of the patient's hearing aid and these are communicated through the patient computer and the global computer network to the clinician computer, the patient's programmed hearing aid parameters are displayed on the monitor at the clinic location.

The clinician can enter adjustments to the patient's program settings on the clinician computer. These adjustments are then communicated via the global computer network to the patient computer at the patient location, where the wireless hearing aid adjustment device uploads the adjusted program settings to the patient's hearing aid. At that time, the patient and clinician can talk to one another, and the patient can report the extent to which the hearing aid performance is improved. Any further corrections or adjustments can be made on the spot. If the patient is at home, he or she can walk into the next room to speak to a family member or to listen to a television program to test to see if the hearing aid performs better under conditions similar to those in which he or she had previously been experiencing a difficulty.

The wireless hearing aid adjustment device can communicate with the patient's hearing aid by low-power short range radio waves, e.g., Bluetooth protocol. The wireless hearing aid adjustment device can includes a necklace-like arrangement, adapted to fit around the neck of the patient, so that the patient can place the wireless hearing aid adjustment device around his or her neck. The wireless device is compact and lightweight, and can be returned, e.g., in a self-addressed return envelope, to the central clinic location. Infrared communication may possibly be employed for adjustment of the hearing aid program.

There may be more than one central clinician location, and in fact there may be any number of practitioners in any number of locations, who are able to connect via Internet to assist patients, in real time, to improve their hearing aid performance. Terms as used in the description and in the claims should be interpreted broadly, and not limited to the illustrated embodiment.

The above and many other objects, features, and advantages of this invention will be more fully appreciated from the ensuing description of a preferred embodiment, which is to be read in conjunction with the accompanying Drawing.

DETAILED DESCRIPTION OF THE PREFERRED EMBODIMENT

Figure 1:
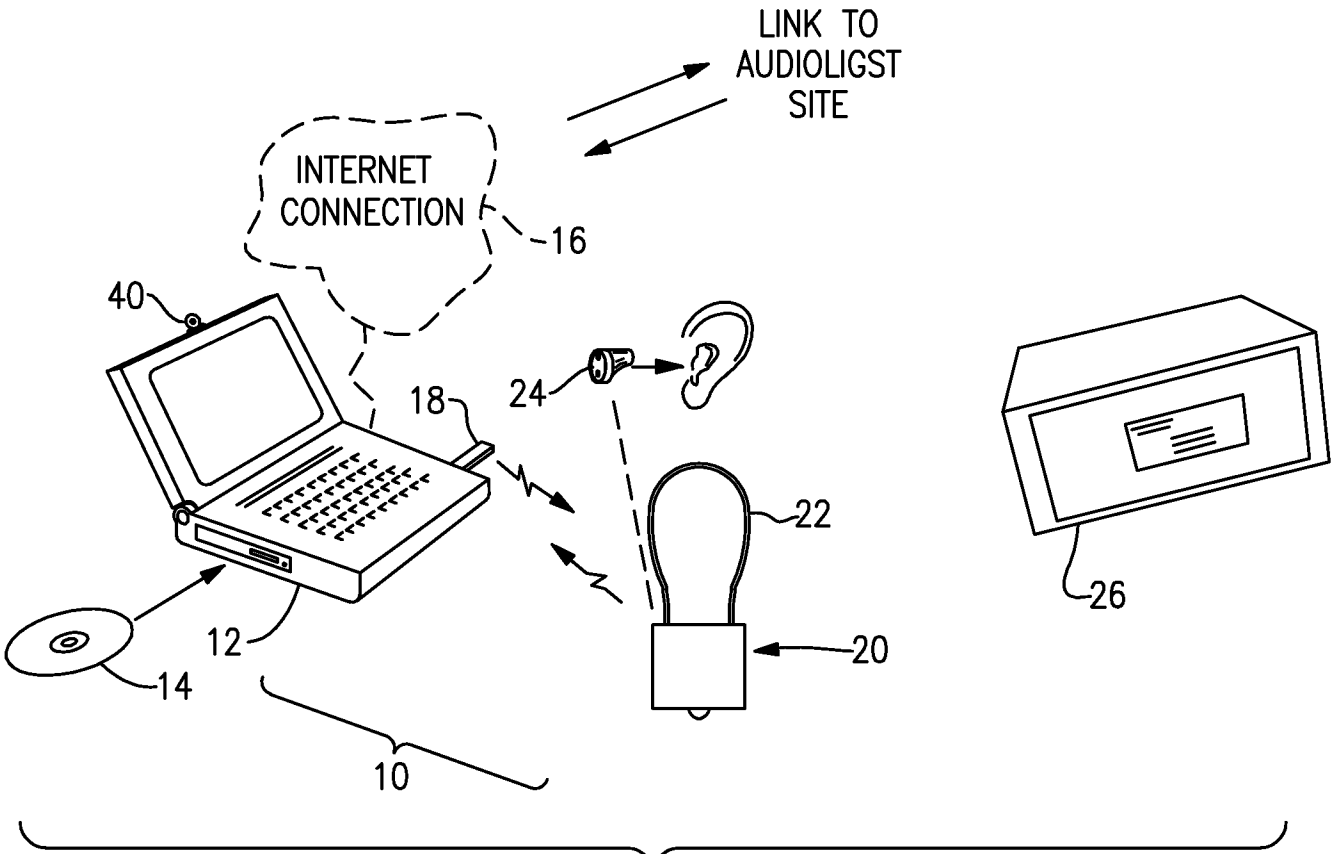
FIG. 1 illustrates an arrangement of equipment involved in a technique of remote, real-time, interactive adjustment of hearing aids, according to an embodiment of the present invention.

With reference now to the Drawing, FIG. 1 shows the set-up and equipment arrangement 10 for a hearing aid patient at the patient location, which may be at the patient's home, for example, or may be at another location convenient to the patient, e.g., a senior center or a Veteran's center. The patient equipment 10 includes a personal computer 12, here shown as a small lap-top device with an incorporated keyboard and pointer device for interfacing with the computer, and a video monitor screen. Software is provided specifically to permit remote connection with a hearing aid practitioner at some distant location and to permit the hearing aids to be reprogrammed as necessary during a session between the patient and the practitioner. In this illustration, the software is contained on a CD-ROM 14 that is mailed or shipped to the patient, but in many or most cases the software can be downloaded to the patient computer 12. An Internet connection 16 is shown here for connecting the patient computer with the practitioner or clinician at a location remote from the patient. A wireless connection 18, which plugs into a convenient USB port on the patient computer 12, connects the computer with a wireless hearing aid programming device 20 which can communicate wirelessly via Bluetooth™ protocol with the patient's hearing aid 24 or hearing aids (one aid 24 is shown here). In this case the patient's hearing aids are Bluetooth-enabled devices, which provide features of wireless connectivity to cell phones, MP3 players and other devices, and which also permit two-way data communication with the digital circuitry within the patient's hearing aid 24. In this instance, the device 20 is neck-worn, and has a necklace or neck strap 22 that fits over the patient's neck. The hearing aid device 24 can be of any design, i.e., behind-ear, in-ear, in-canal, etc., and in most instances the patient would be wearing two hearing aids, one in the right ear and one in the left ear. The hearing impairment may be different in each ear. The patient may call the hearing clinic by phone or contact the clinic by Internet to set up a hearing appointment, and in this proposed arrangement the clinic will mail or ship the software disk 14 and the hearing aid programming device 20 to the patient location in time for the appointment that is scheduled. A return envelope 26 is provided also, to facilitate the patient returning the device 20 after the scheduled session with the remotely located hearing practitioner. This envelope 26 is pre-addressed and with the shipping or postage pre-paid. In some cases, e.g., where the patient location is at a Veteran's center or senior center, that facility may retain the device 20, so that it may be used with any number of hearing patients for conducting real-time interactive hearing aid adjustment sessions.

Figure 2:
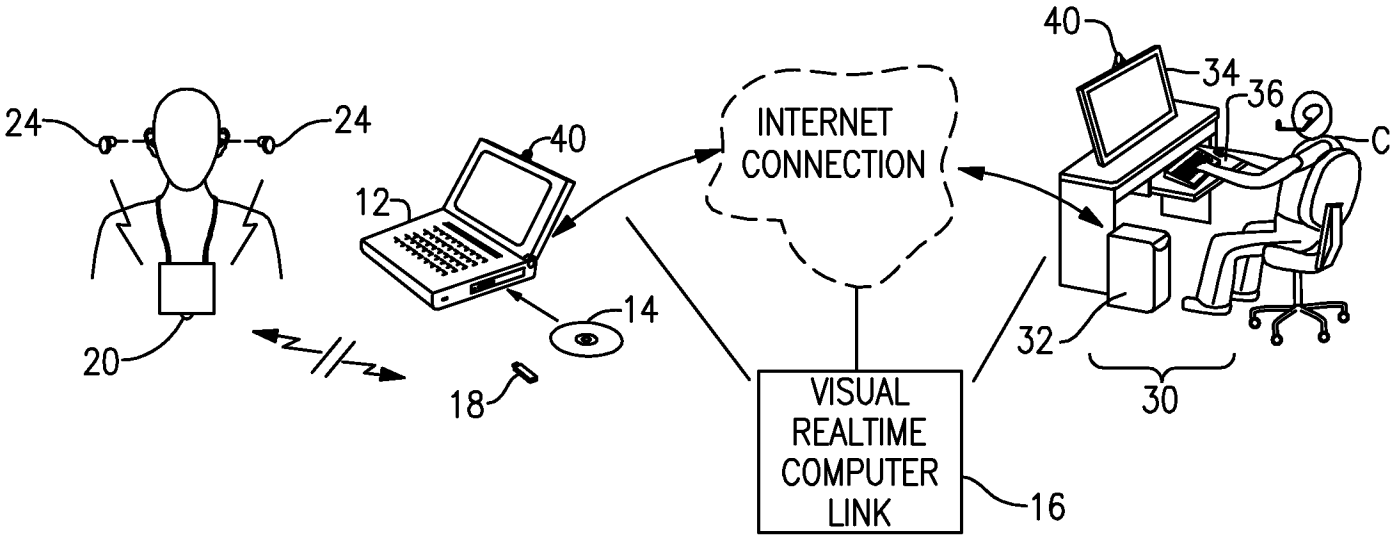
FIG. 2 is a schematic system view illustrating the arrangement of this embodiment.

FIG. 2 shows the arrangement with both the patient P at patient location 10 and the practitioner or clinician C at a central clinic location 30 that is remote from the patient location, but connected via Internet, using a visual and real-time computer link i.e., Internet connection 16. The patient P is shown with both left and right hearing aids 24, and the neck-worn wireless hearing aid programming device 20, which is wirelessly connected to the patient's computer 12. The practitioner C at the clinic location 30 employs a suitably programmed computer with a processor 32, video monitor 34 and keyboard or other interface device 36. Here the hearing practitioner C has a headset for two way voice communication with the patient, and each of the patient computer and the practitioner computer have video camera 40 to allow visual imaging of the patient and of the practitioner.

Figure 3:
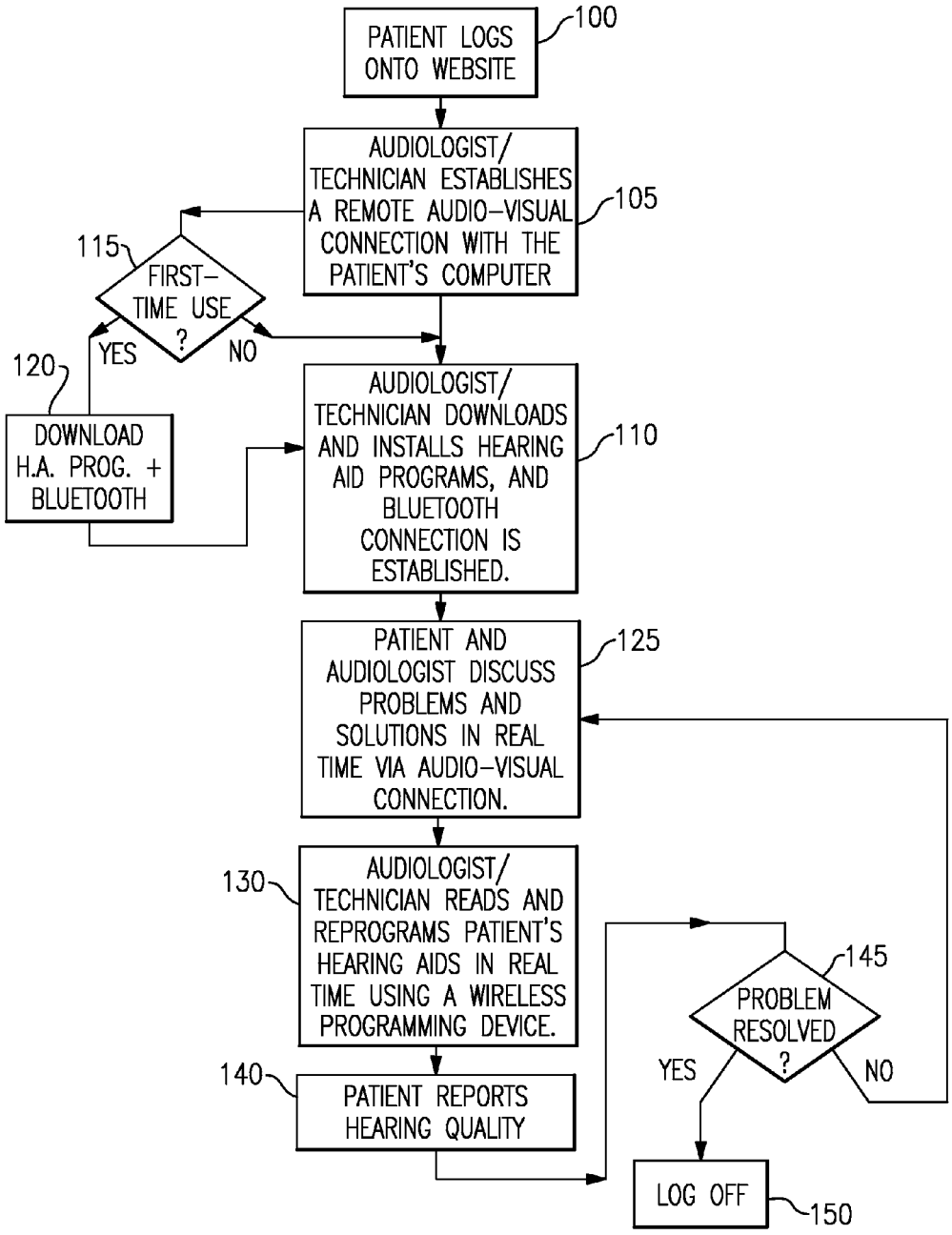
FIG. 3 is a flow diagram of the remote, real-time interactive adjustment technique of this embodiment of the invention.

Turning now to FIG. 3, the process or technique of this invention can be described as a series of steps, which may be iterated as needed. As aforesaid, the patient, at home or at a convenient location, first schedules a session with the hearing clinic. Then the patient is provided with the required software and equipment. At the time of the appointment, the patient logs onto a hearing clinic website (block 100) and the audiologist or hearing technician at the clinic location establishes a remote audio-visual connection with the patient's computer (block 105). At this time the audiologist or technician ensures that the Bluetooth connection is established with the patient's Bluetooth-enabled hearing aids 24 (block 110), and downloads the hearing aid settings from the patient's hearing aids. In case this patient is a first-time user not provided with software on a disk 14, or if the patient does not possess the most recent version of the patient software (see block 115) the clinician computer system will download the hearing aid adjustment program for Bluetooth- or wireless-enabled hearing aids (block 120) to the patient computer via the established Internet connection.

The patient and the clinician discuss the problems that the patient may be experiencing with the performance of the patient's hearing aids. (Block 125) This allows the clinician to suggest possible changes to the hearing aid program, so that he or she can address the problems that the patient is experiencing. This may involve changes in gain in one or more frequency bands, or may involve dynamic range compression adjustments in one or more bands, for example. In some cases, the problem may be mechanical, such as wax buildup on the instrument receiver, or improper battery installation. Those may also be discussed with the patient. However, if a change to the patient's hearing aid program is needed, this is carried out by making the adjustments on the clinic computer.

The clinician (audiologist or hearing technician) reads the characteristics of the current program on the patient's hearing aid(s) and then alters the programs for the aids on the clinic computer (block 130). The altered programs are transmitted immediately via Internet connection 16 to the patient computer 12, and the computer together with the neck-worn Bluetooth enabled wireless device 20 re-programs the patient's hearing aids in real time. After this, the patient can report whether the hearing quality is sufficiently improved (block 140). If the problem is not resolved (block 145) the above steps (125) to (140) can be repeated, until the proper adjustments have been made to the patient's programmable hearing aids. After the patient' hearing problems have been resolved satisfactorily (block 145), the session is concluded, and the patient logs off (block 150).

In some possible hearing aid designs, Bluetooth-enabled hearing aids 24 may permit the patient P to speak with and/or listen to the audiologist or hearing practitioner C. Otherwise, the communication can be carried out using speaker and microphone pickups on the patient's computer.

It is envisioned that audiology clinicians can be available on a demand basis, so that the patient can contact the clinic, via Internet, anytime night or day, and resolve hearing aid problems without delay. The clinic or clinics may serve patients over a wide geographical area without requiring the patient to visit the physical site of the clinic.

The clinician will be able to learn the manufacturer and model of the hearing aids, in addition to the patient's loss profile and the hearing correction program from data that is contained in the memory of the hearing aid, and which can be downloaded wirelessly from each of the patient's hearing aids. When the patient logs in to the hearing clinic web site, the clinician can then log in to each of the patient's programmable hearing aids, and obtain the history and setting profiles of each of the patient's hearing aids. By asking the patient about the patient's specific hearing problems and the types of hearing difficulties he or she is experiencing with the hearing aids, the clinician can make a judgment, based on the clinician's experience in audiology practice, about what possible changes to make to the hearing aid programs to remedy the problem. These changes can be made in real time and transmitted via the patient computer to the hearing aids to reprogram them. If the improvement to the patient's hearing is not quite satisfactory, additional changes to the programs can be made on the spot, and the hearing aids reprogrammed again, in real time. This can be continued until the patient reports that the hearing aid performance seems satisfactory.

Because the patient may be located in his own home or at a familiar location, the patient can test the hearing improvement by walking to another room, going out of doors, turning on a television, etc. during the session. Those environmental conditions, where the patient is or may be experiencing hearing problems, would be difficult to simulate or reproduce at the actual clinic facility.

While the invention has been described in respect to a preferred embodiment, the invention is not limited only to that embodiment. Rather, the scope and spirit of this invention is to be defined in accordance with the appended claims.

I claim:

1. Arrangement for interactive real-time remote analysis and adjustment of a hearing aid for a hearing patient, in which a hearing aid clinician at a central clinic location is able to analyze and adjust performance and program settings of one or more programmable hearing aids of a hearing patient who is present at a patient location that is remote from said central clinic location, the arrangement comprising at said central clinic location, a suitably programmed computer having a processor, an interface device for use by the clinician, a video monitor screen, and an Internet connection to connect the clinician computer with a global computer network; and software permitting analysis of program settings of a patient's hearing aid in real time by the clinician and permitting the clinician at the central clinic location to adjust the settings of the hearing aid while the patient is wearing the aid; and software providing real time communication between the clinician and the patient at the remote patient location;

at said remote patient location, a patient-operated computer including a processor, a video monitor screen, a patient-computer interface device, and an Internet connection to connect the patient computer with said global computer network; software installed on said patient computer to permit the clinician to obtain a remote connection to gain control of the patient computer, to analyze program settings of the patient hearing aid and adjust the patient's hearing aid by use of the interface device of the clinician computer; and a wireless device connected with the patient computer and communicating wirelessly with the patient's hearing aid at the patient location, the device being able to transmit data corresponding to program settings of the hearing aid between the hearing aid and the patient computer, and thence between the patient computer and the computer at the central clinic location.

2. The arrangement of claim 1 wherein said wireless device employs short-range low-power radio to communicate with the patient's hearing aid.

3. The arrangement of claim 2 wherein said wireless device includes a necklace incorporated therewith to permit the patient to wear the wireless device on the patient's neck.

4. The arrangement of claim 1 further comprising a pre-addressed return envelope permitting the patient to return the wireless device to the central clinic location following a remote adjustment session with the clinician.

5. A method for interactive, real-time analysis and adjustment of a hearing aid of a patient, wherein a hearing aid clinician is located at a central clinic location and is able to analyze and adjust the performance and program settings of one or more programmable hearing aids of a hearing aid patient who is present at a patient location that is remote from said clinic location, the method comprising providing the clinician at the clinic location with a suitably programmed computer having an interface device for use by the clinician, a video monitor screen, an Internet connection to connect the clinician computer with a global computer network, and software permitting analysis of program settings of a patient's hearing aid and permitting the clinician to adjust the program settings of the patient's hearing aid, while the patient is wearing the hearing aid wherein the clinician computer is adapted to provide real-time communication between the clinician at the clinic location and the patient at the patient location; and providing the patient at the patient location a patient computer including a processor, a video monitor screen, a patient-computer interface device, and an Internet connection to connect the patient computer with said global computer network; the method further comprising installing on the patient computer software to permit the clinician to gain control of the patient computer through said Internet connection, and to analyze and adjust the patient's hearing aid, while it is being worn by the patient, through the clinician computer connected via said global computer network with the patient computer;

providing the patient with a wireless hearing aid adjustment device;

connecting the wireless hearing aid adjustment device with the patient computer;

the wireless hearing aid adjustment device communicating wirelessly with the patient's hearing aid while the aid is present in the ear of the patient;

obtaining via the wireless hearing aid adjustment device program settings of the patient's hearing aid and communicating the settings through the patient computer and the global computer network to the clinician computer, and displaying said settings on the monitor at said clinic location;

the clinician entering adjustments to said program settings on the clinician computer; and the clinician computer communicating said adjustments through the global computer network to the patient computer at the patient location;

the wireless hearing aid adjustment device uploading the adjusted program settings to the patient's hearing aid to re-fit the hearing aid in real time.

6. The method of claim 5 wherein said wireless hearing aid adjustment device communicates with the patient's hearing aid with low-power short range radio waves.

7. The method of claim 6 further said wireless hearing aid adjustment device and hearing aid communicate via a Bluetooth protocol.

8. The method of claim 5 wherein the wireless hearing aid adjustment device includes a necklace adapted to fit around the neck of the patient, and further comprising the patient placing the wireless hearing aid adjustment device around his or her neck.

9. The method of claim 5 also comprising providing the patient with a self-addressed return envelope adapted for returning the wireless hearing aid adjustment device to the central clinic location.

10. The method of claim 5 wherein the patient communicates real-time feedback to the clinician concerning specific problems that he or she is experiencing with the hearing aid, and the clinician makes real-time adjustments to the program based on said real-time feedback.

11. The method of claim 5 wherein said software installed on the patient computer establishes a remote audio-video connection between the clinician computer and the patient computer to provide video imaging of the patient and the clinician so that the patient and clinician can see images of one another and can talk and listen to one another.

* * * * *